US009054438B2

(12) United States Patent
Endo et al.

(10) Patent No.: US 9,054,438 B2
(45) Date of Patent: Jun. 9, 2015

(54) CONNECTOR TERMINAL

(71) Applicant: DAI-ICHI SEIKO CO., LTD., Kyoto (JP)

(72) Inventors: Takayoshi Endo, Shizuoka (JP); Sakai Yagi, Shizuoka (JP); Masaya Muta, Shizuoka (JP); Shunya Oohashi, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 74 days.

(21) Appl. No.: 13/951,765

(22) Filed: Jul. 26, 2013

(65) Prior Publication Data

US 2014/0030935 A1 Jan. 30, 2014

(30) Foreign Application Priority Data

Jul. 27, 2012 (JP) ..... 2012-167007

(51) Int. Cl.
*H01R 4/48* (2006.01)
*H01R 13/15* (2006.01)
(Continued)

(52) U.S. Cl.
CPC ..... *H01R 13/15* (2013.01); *H01R 12/58* (2013.01); *H01R 12/712* (2013.01); *H01R 12/91* (2013.01); *H01R 13/114* (2013.01); *H01R 13/20* (2013.01); *H01R 13/4223* (2013.01)

(58) Field of Classification Search
CPC ..... H01R 23/725; H01R 9/096; H01R 12/57; H01R 13/41; H01R 23/6886; H01R 4/4809; H01R 4/481; H01R 43/16
USPC ..... 439/889, 74, 856, 857, 861, 845, 849, 439/850, 252, 246, 595, 816
See application file for complete search history.

(56) References Cited

U.S. PATENT DOCUMENTS 4,564,259 A * 1/1986 Vandame ..... 439/852
4,966,557 A 10/1990 Barkus et al.
(Continued)

FOREIGN PATENT DOCUMENTS

EP 2 151 891 2/2010
JP 5-55468 7/1993
(Continued)

OTHER PUBLICATIONS

Japanese Office Action issued Aug. 6, 2013 in Japanese Patent Application No. 2012-167007.
(Continued)

*Primary Examiner* — Abdullah Riyami
*Assistant Examiner* — Thang Nguyen
(74) *Attorney, Agent, or Firm* — Wenderoth, Lind & Ponack, L.L.P.

(57) ABSTRACT

A connector terminal includes a main body, a support leg, and a resilient portion. The main body includes a contact portion making contact with a first side of a male connector terminal of a male electric connector, a spring portion facing the contact portion and making contact with the second side of the male connector terminal, a support portion supporting the spring portion, and a space-limiter (joint portion) restricting a space between the contact portion and the support portion from spreading. The support leg is adapted to be fixed at one of the ends thereof. The resilient portion connects the other end of the support leg and the contact portion to each other and is resiliently deformable in accordance with deflection of the main body.

8 Claims, 22 Drawing Sheets

(51) Int. Cl.

| | |
|---|---|
| ***H01R 12/91*** | (2011.01) |
| ***H01R 13/11*** | (2006.01) |
| *H01R 12/58* | (2011.01) |
| *H01R 12/71* | (2011.01) |
| *H01R 13/20* | (2006.01) |
| *H01R 13/422* | (2006.01) |

(56) References Cited

U.S. PATENT DOCUMENTS

| | | | | |
|---|---|---|---|---|
| 6,042,433 | A * | 3/2000 | Chen | 439/852 |
| 6,203,385 | B1 * | 3/2001 | Sato et al. | 439/852 |
| 6,283,803 | B1 * | 9/2001 | Sato et al. | 439/852 |
| 6,352,453 | B2 * | 3/2002 | Saitoh | 439/843 |
| 6,447,345 | B2 * | 9/2002 | Sato et al. | 439/852 |
| 6,568,955 | B2 | 5/2003 | Hotea et al. | |
| 6,851,989 | B2 * | 2/2005 | Maeda | 439/852 |
| 7,387,550 | B2 * | 6/2008 | Myer et al. | 439/852 |
| 8,241,077 | B2 * | 8/2012 | Suzuki et al. | 439/852 |

FOREIGN PATENT DOCUMENTS

| | | |
|---|---|---|
| JP | 9-180798 | 7/1997 |
| JP | 2579908 | 6/1998 |
| JP | 10-284193 | 10/1998 |
| JP | 2001-338739 | 12/2001 |
| JP | 2002-198112 | 7/2002 |

OTHER PUBLICATIONS

European Search Report (ESR) issued Oct. 24, 2013 in corresponding European Patent Application No. EP 13 17 6716.

* cited by examiner

CONNECTOR TERMINAL

BACKGROUND OF THE INVENTION

1. Field of the Invention

The invention relates to a connector terminal of a female electric connector, including a contact portion and a spring portion between which a male connector terminal of the male electric connector is sandwiched to thereby make electrical contact with the male connector terminal.

2. Description of the Related Art

A connector terminal for sandwiching therebetween a male connector terminal of a male electric connector is used to thereby electrically connect printed circuit boards to each other or a cable to a printed circuit board.

For instance, Japanese Utility Model No. 2579908 has suggested a connector including a spring terminal.

FIG. 21 is a plan view of the spring terminal 50 suggested in the above-identified Japanese Utility Model, and FIG. 22 is a cross-sectional view of a housing into which the spring terminal 50 is inserted.

As illustrated in FIGS. 21 and 22, the spring terminal 50 includes a leg 51, a straight portion 53 passing through a terminal holder 52 of an electrically insulating housing 70 and extending along a support 71 of the housing 70, a first bending portion 54 bending almost perpendicularly from the straight portion 53, a second bending portion 55 downwardly bending along the support 71, a first necking portion 56 for holding a male connector 60, an almost semi-circular bottom 57 extending along a bottom 72 of the housing 70, a second necking portion 58 located symmetrically with the first necking portion 56, and a free end 59 extending symmetrically with the second bending portion 55, and making engagement with a projection B of the housing 70.

FIG. 23 is a perspective view of a connector suggested in Japanese Patent Application Publication No. H10 (1998)-284193.

The connector 80 electrically connecting a terminal pin 85 to a printed circuit board 90 includes a pair of pin contacts 81 each making electrical contact with the terminal pin 85, a pair of arms 82 each extending outwardly from the pin contact 81 and deformable when pressurized, and a pair of contacts 83 each formed at a distal end of the arm 82 and making electrical contact with the printed circuit board 90.

The printed circuit board 90 is formed with an opening 91 into which the pin contacts 81 are inserted, and openings 92 into which the contacts 83 are inserted.

However, the above-mentioned spring terminal and connector are accompanied with problems as follows.

In the spring terminal 50 illustrated in FIGS. 21 and 22, when the male connector 60 is inserted into the spring terminal 50, the second necking portion 58 is outwardly deformed. Hence, the free end 59 located adjacent to the second necking portion 58 is caused to outwardly move, resulting in that a contact pressure which the second necking portion 58 exerts on the male connector 60 is reduced. Thus, reliability in electrical connection between the spring terminal 50 and the male connector 60 is unavoidably deteriorated.

As an alternative, if the male connector 60 is inserted into the spring terminal 50 with the male connector 60 being slipped towards the second necking portion 58, the second necking portion 58 is caused to further outwardly be deformed, in which case, since the male connector 3 more intensively compresses the second necking portion 58, a contact pressure which the second necking portion 58 exerts on the male connector 60 is increased. However, since the male connector 60 moves away from the first necking portion 56, a contact pressure which the first necking portion 56 exerts on the male connector 60 is unavoidably reduced.

In the connector 80 illustrated in FIG. 23, even if the terminal pin 85 were inserted between the pin contacts 81, since the pin contacts 81 are inserted into the opening 91, a space between the pin contacts 81 would not be spread. Accordingly, it is possible to avoid reduction in a contact pressure which the pin contacts 81 exerts on the terminal pin 85.

However, if a positional relation between an electric unit including the terminal pin 85 and the printed circuit board 90 were deflected, a contact pressure which the pin contact 81 located remote from the terminal pin 85 exerts on the terminal pin 85 would be unavoidably reduced, resulting in deterioration in reliability in electrical connection between the terminal pin 85 and the connector 80.

As mentioned above, if a male connector is inserted into a female connector with a positional relation between them being deflected, a contact pressure which the female connector exerts on the male connector is reduced, and further, the male and female connectors has a risk of being buckled.

Furthermore, a positional relation between male and female connectors is generated even after a male connector is inserted into a female connector. In particular, in an electric connector equipped in an automobile, a positional relation between a printed circuit board on which a female connector is mounted and another printed circuit board on which a male connector is mounted is prone to be deflected due to oscillation generated while an automobile is running, and a difference in thermal expansion caused by temperature fluctuation around the printed circuit boards. Though the deflection in the positional relation can be suppressed when one of housings is fit into the other, deflection in clearances of the housings is generated. Thus, each time a male connector moves when an automobile oscillates, it is important for a female connector to provide reliability in electrical connection with the male connector.

SUMMARY OF THE INVENTION

In view of the above-mentioned problems in the conventional connectors, it is an object of the present invention to provide a connector terminal capable of avoiding reduction in reliability in electrical connection between male and female connectors, even if the male connector is inserted into the female connector in deflected condition, or even if the male connector is deflected relative to the female connector after the male connector is inserted into the female connector.

In one aspect of the present invention, there is provided a connector terminal includes a main body, a support leg, and a resilient portion. The main body includes a contact portion making contact with one side of a male connector terminal of a male electric connector, a spring portion facing the contact portion and making contact with the other side of the male connector terminal, a support portion supporting the spring portion, and a space-limiter restricting a space between the contact portion and the support portion. The support leg is adapted to be fixed at one of ends thereof, and the resilient portion connects the other end of the support leg and the contact portion to each other and is resiliently deformable in accordance with deflection of the main body.

The connector terminal in accordance with the present invention makes it possible to prevent the spring portion from outwardly spreading, even if a male connector having been inserted thereinto deflects towards the spring portion, because the space-limiter prevents a space between the contact portion and the support portion from spreading. Furthermore, since the main body is connected to the support leg through the resilient portion, and further, the support leg is fixed to, for instance, a printed circuit board, even if a male connector deflects towards the contact portion, the resilient portion resiliently deforms with the male connector being inserted into the main body, that is, the main body is able to move independently of the resilient portion. Thus, it is possible to cause the main body to follow the deflection of a male connector, maintaining a contact pressure which the main body exerts on the male connector.

For instance, the resilient portion may be designed to connect a top end of the contact portion and the support leg to each other, in which case, in comparison with designing the resilient portion to connect the support let to a bottom end of the contact portion, it is possible to lower a height of the connector terminal by a height of the resilient portion, ensuring reduction in a height of an electric connector including the connector terminal.

As an alternative, the resilient portion may be designed to connect the support leg and a bottom end of the contact portion to each other.

It is preferable that the space-limiter comprises a joint portion connecting a side of the contact portion and a side of the support portion to each other.

The space-limiter keeps a constant space between the contact portion and the spring portion. Thus, even if a male connector deflects and compresses the spring portion to cause the support portion to outwardly spread, it is possible to prevent the support portion from spreading.

As an alternative, the space-limiter may be designed to comprise a joint portion connecting a lower end of the contact portion and a lower end of the support portion to each other, in which case, it is preferable that the connector terminal further includes a stepped portion over the contact portion, the joint portion and the support portion. By designing the space-limiter to include the joint portion and designing the connector terminal to further include the stepped portion, it is possible to enhance rigidity of the contact portion, the joint portion, and the support portion. Accordingly, even if a male connector deflects and attempts to compress the spring portion to thereby cause the support portion to outwardly spread, it is possible to prevent the support portion from spreading.

It is preferable that the stepped portion is formed by beading to be recessed at one side and raised at the other side. By carrying out a single step, it is possible to form two steps each including recessed and raised portions and extending over the contact portion, the joint portion, and the support portion.

It is preferable that the contact portion is formed with at least one projection making engagement with one side of the male connector terminal. In that case, it is possible to concentrate a contact pressure to the projection so that the connector terminal can surely make electrical contact with a male connector.

The advantages obtained by the above-mentioned present invention will be described hereinbelow.

In the connector terminal in accordance with the present invention, the resilient portion resiliently deforms with a male connector being inserted into the main body. Accordingly, the main body is able to follow the deflection of a male connector, maintaining a contact pressure which the main body exerts on the male connector. Thus, the connector terminal in accordance with the present invention avoids deterioration in reliability in electrical connection with a male connector, even if a male connector having been inserted into the connector terminal deflects.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

A male electric connector in accordance with the first embodiment of the present invention is explained hereinbelow with reference to the drawings.

In the specification, a male connector terminal of the male electric connector is located "above" a printed circuit board.

Figure 1:
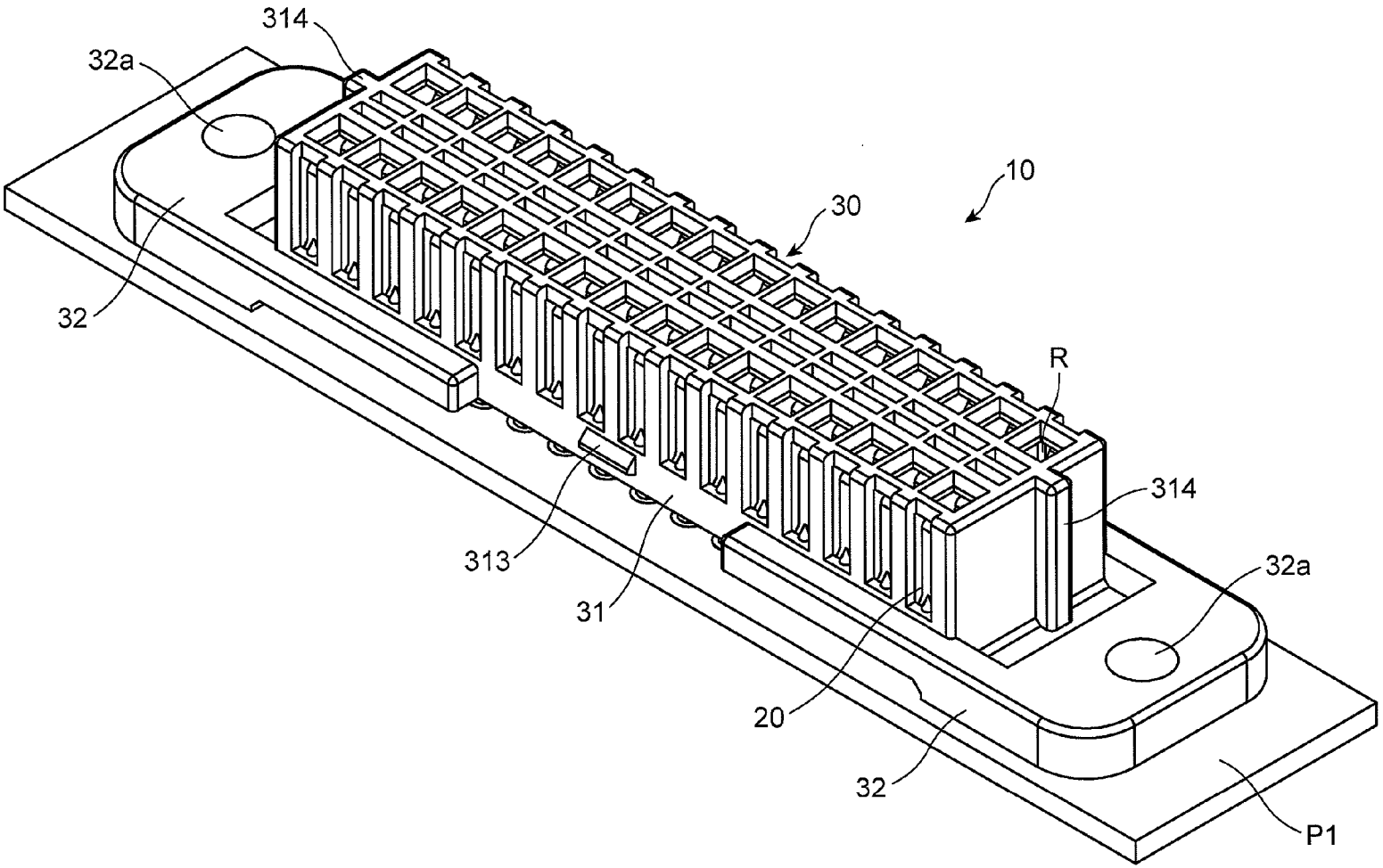
FIG. 1 is a perspective view of a female electric connector in accordance with the first embodiment of the present invention being mounted on a printed circuit board.
Figure 2:
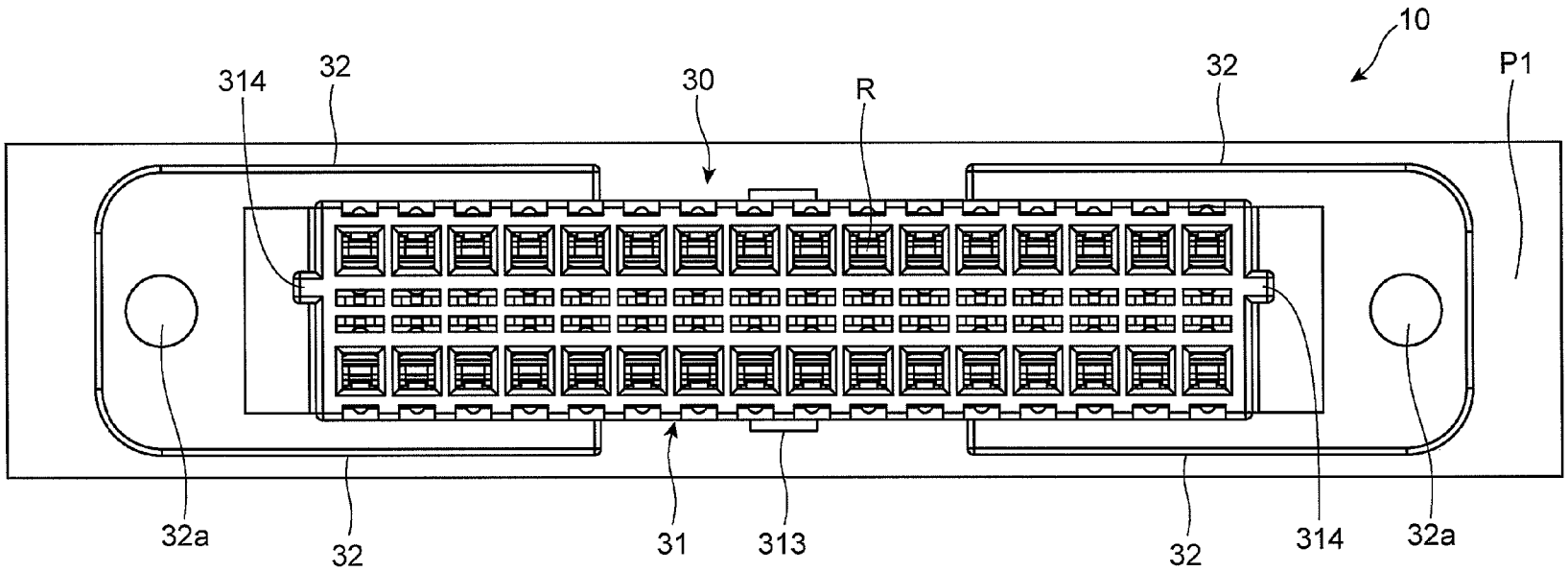
FIG. 2 is a plan view of the electric connector illustrated in FIG. 1.
Figure 3:
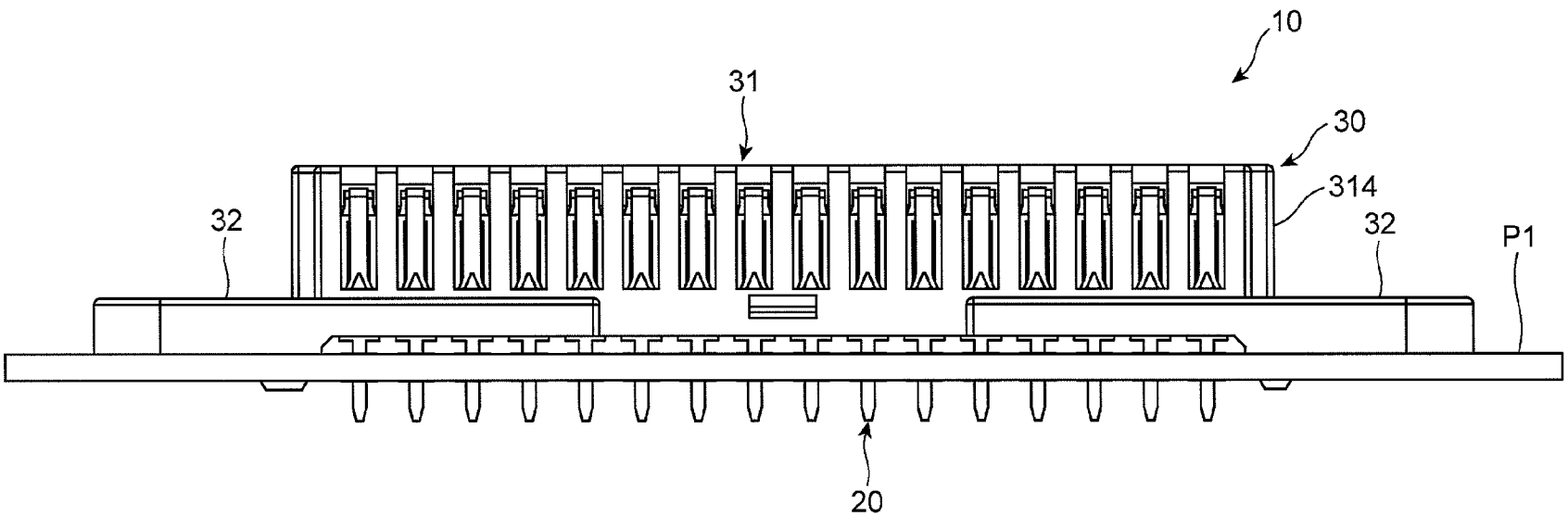
FIG. 3 is a front view of the electric connector illustrated in FIG. 1.
Figure 4:
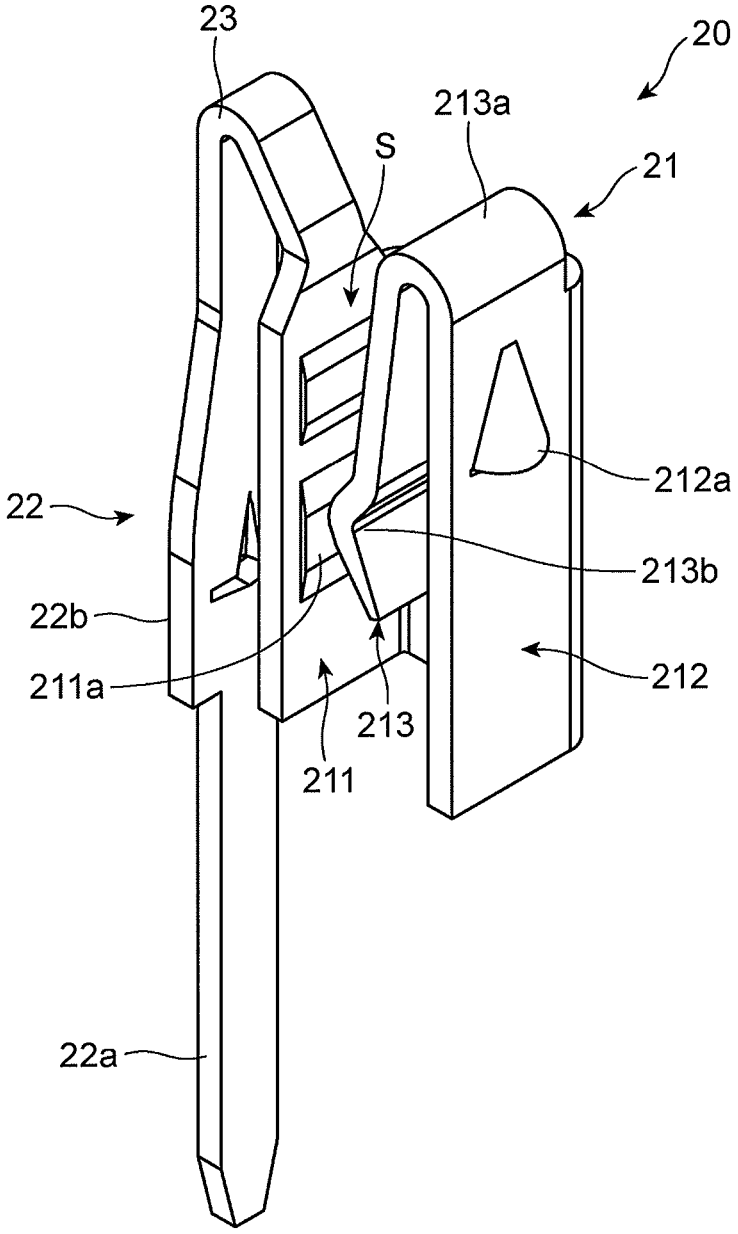
FIG. 4 is a perspective view of the connector terminal of the electric connector illustrated in FIG. 1, viewed in a direction of the support portion.
Figure 5:
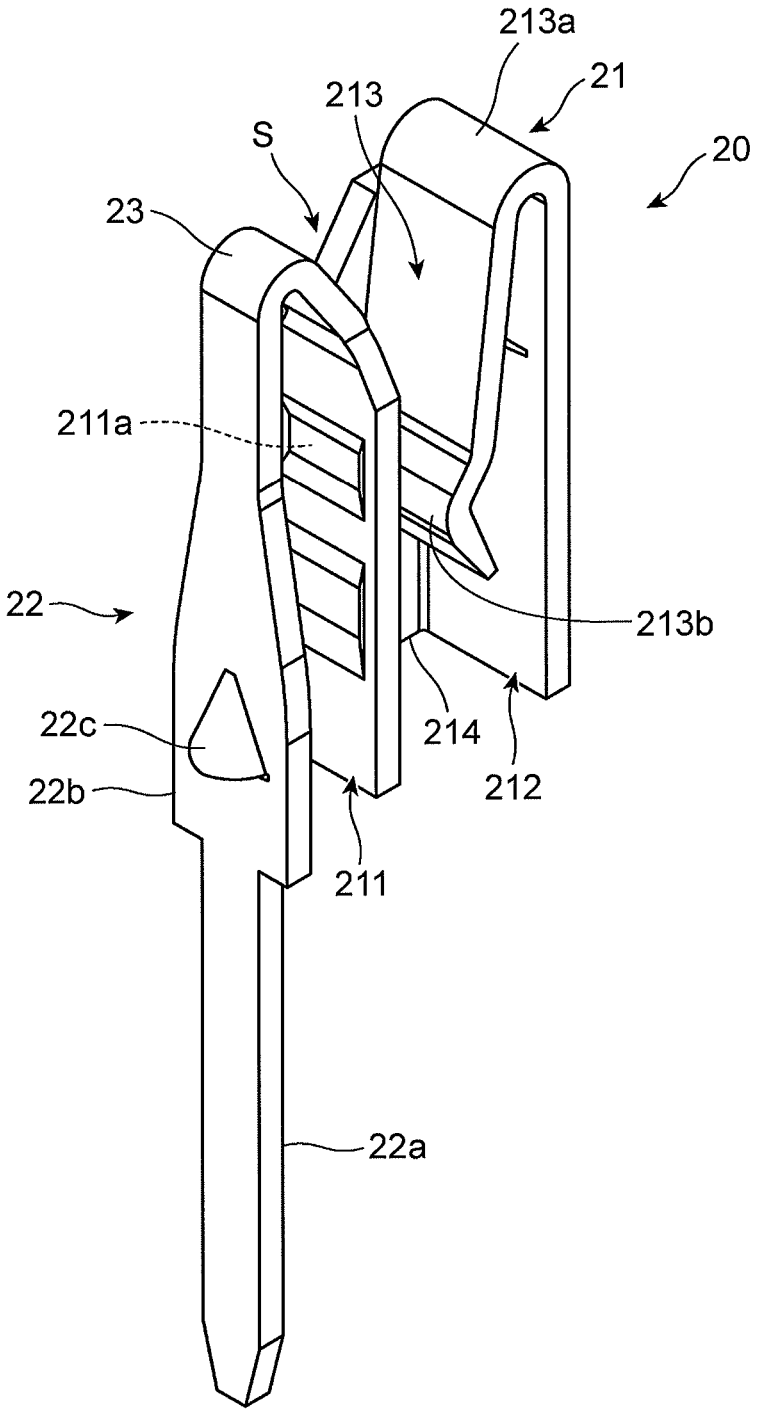
FIG. 5 is a perspective view of the connector terminal of the electric connector illustrated in FIG. 1, viewed in a direction of the support leg.
Figure 6:
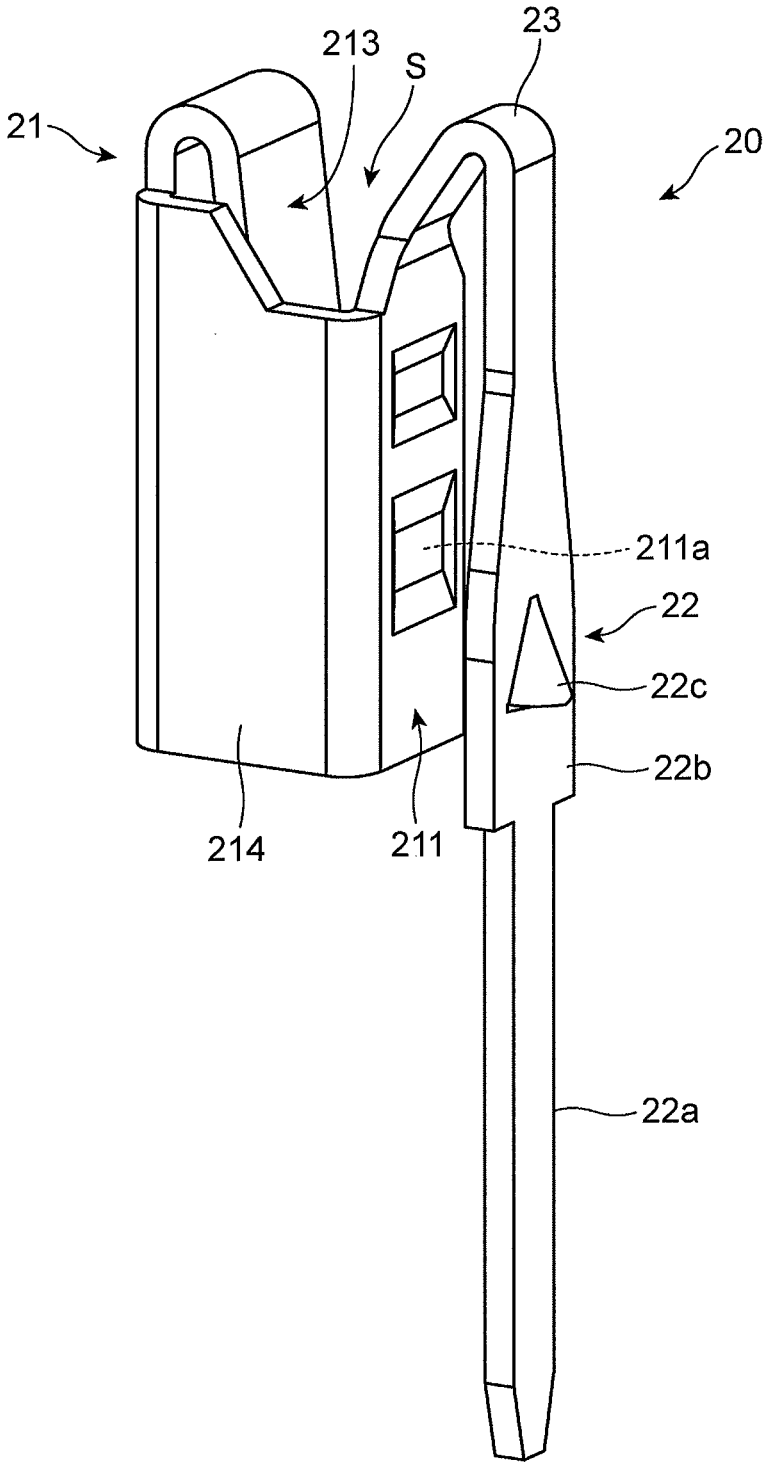
FIG. 6 is a perspective view of the connector terminal of the electric connector illustrated in FIG. 1, viewed in a direction of the joint portion.
Figure 7:
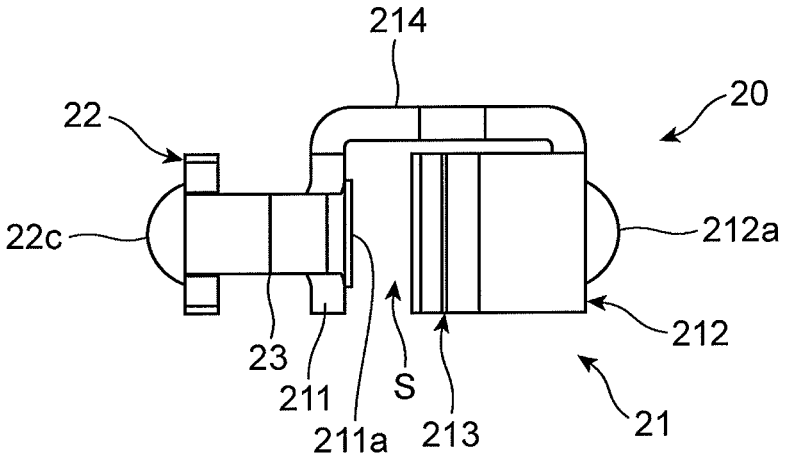
FIG. 7 is a plan view of the electric connector illustrated in FIG. 4.
Figure 8:
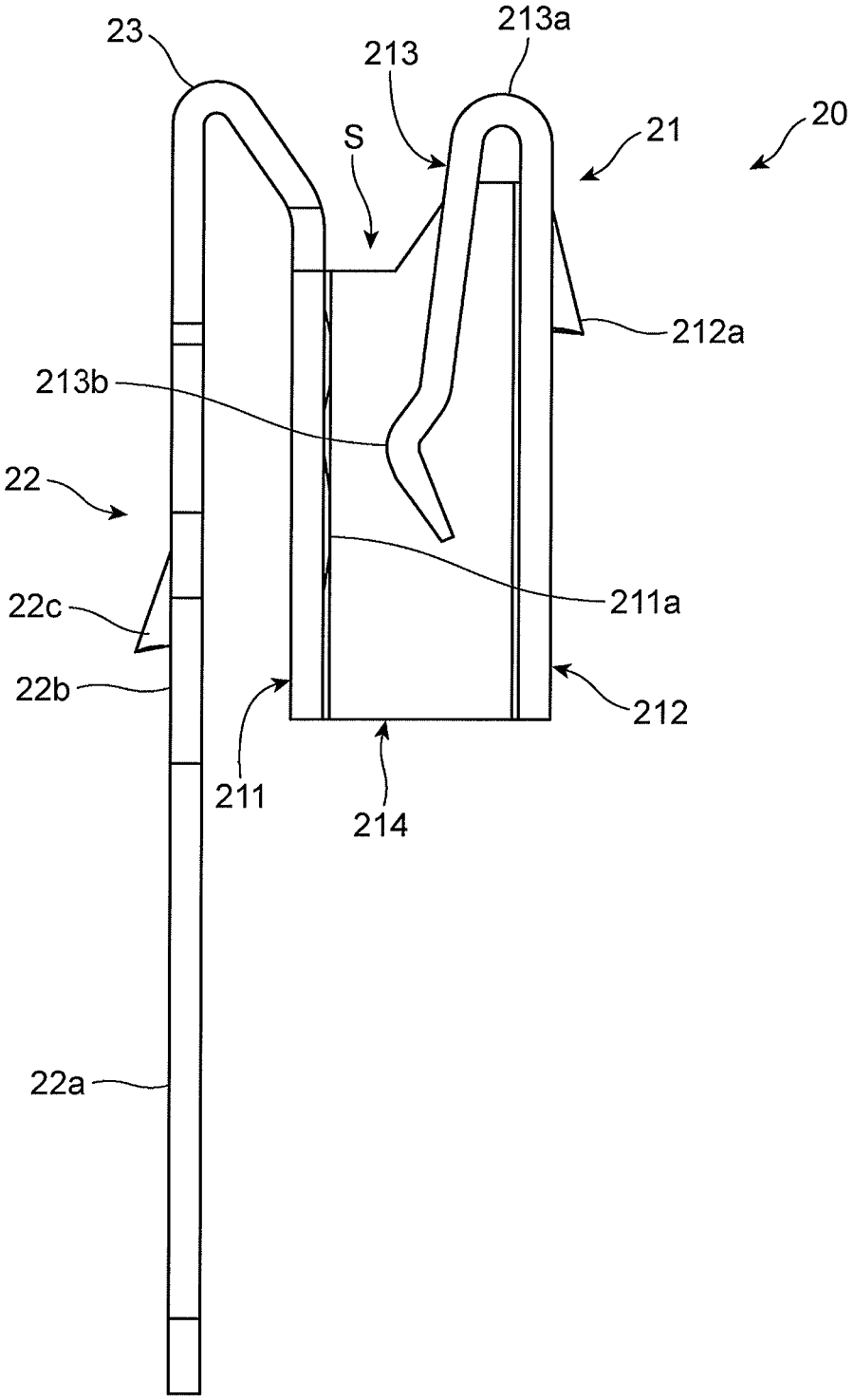
FIG. 8 is a front view of the electric connector illustrated in FIG. 4.

As illustrated in FIGS. 1 to 3, the electric connector 10 in accordance with the first embodiment is mounted on a printed circuit board P1, a circuit board to be equipped in an automobile, and is fit into a male electric connector 100 mounted on a printed circuit board P2 (illustrated in FIGS. 9 to 11) to thereby electrically connect the printed circuit boards P1 and P2 to each other.

The electric connector 10 includes a plurality of connector terminals 20, and a housing 30.

The connector terminal 20 illustrated in FIGS. 4 to 8 is inserted into a terminal storage room R formed in the housing 30. The connector terminal 20 includes a main body 21, a support leg 22, and a resilient portion 23 connecting the support leg 22 to the main body 21. The connector terminal 20 is formed by punching a single metal plate, and bending the metal plate.

The main body 21 includes a contact portion 211, a spring support portion 212, a spring portion 213, and a joint portion (space limiter) 214.

The contact portion 211 comprises a terminal making contact with one side of a male connector terminal. The contact portion 211 is formed at a contact surface thereof with two substantially rectangular projections 211*a*. The projections 211*a* are formed by beading.

The spring support portion 212 supports the spring portion 213. The support portion 212 is formed at a rear surface (opposite side relative to the spring portion 213) with a substantially triangular projection 212*a* making engagement with a raised portion of the housing 30. The projection 212*a* is formed by pressing, including a step of cutting a bottom of the triangle.

The spring portion 213 is disposed facing the contact portion 211 such that a space S is formed between the spring portion 213 and the contact portion 211, into which a male connector terminal 110 (see FIG. 9) of a male electric connector 100 (see FIG. 9) is inserted. The spring portion 213 is designed to have almost the same width as that of the spring support portion 212, and extends downwardly from a top end of the spring support portion 212 through a bending portion 213*a* to thereby make contact with the other side of the male connector terminal 110. The spring portion 213 has a structure of a flat spring. The spring portion 213 is formed at a distal end thereof with a contact 213*b* formed by bending the metal plate to be substantially V-shaped.

The joint portion 214 acts as a space-limiter restricting a space between the contact portion 211 and the spring support portion 212 from spreading. The joint portion 214 connects a side of the contact portion to a side of the support portion, wherein the sides extend in a direction in which the male connector terminal 110 is inserted into and pulled out of the space S.

The support leg 22 has a first end 22*a* inserted into the printed circuit board P1 to thereby fix the support leg 22 on the printed circuit board P1, and the second end is connected to the resilient portion 23. The support leg 22 is formed with a width-increased portion 22*b* in order to insert the connector terminal 20 into the terminal storage room R of the housing 30 in a designed position. The support leg is formed further with a substantially triangular projection 22*c* making engagement with a projection formed with the housing 30. The projection 22*c* is formed by pressing, including a step of cutting a bottom of the triangle.

The resilient portion 23 is designed to have a width smaller than the width of the width-increased portion 22*b* of the support leg 22 in order to be readily resiliently deformable. The resilient portion 23 comprises a substantially U-shaped flat spring disposed between a distal end of the support portion 22 and a proximal or top end of the contact portion 211.

The housing 30 illustrated in FIGS. 1 to 3 is substantially rectangular, when viewed vertically, and includes a housing main body 31 in which the terminal storage rooms R into each of which the connector terminal 20 is housed are formed in a matrix, and a pair of flanges 32 outwardly extending from opposite ends of the housing main body 31 in a length-wise direction of the housing main body 31.

Figure 13:
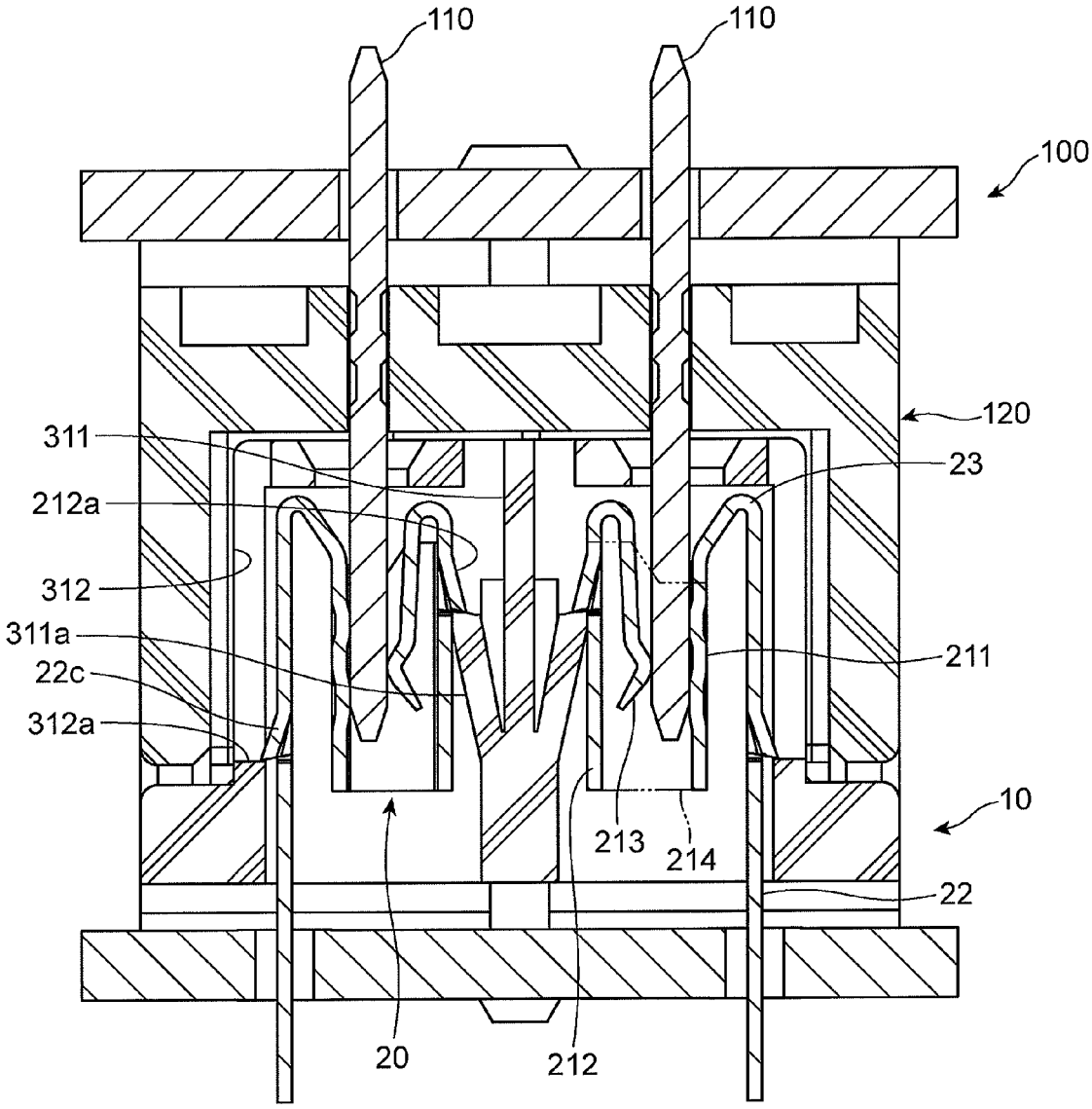
FIG. 13 is a cross-sectional view of the male and female electric connectors illustrated in FIG. 12.

As illustrated in FIG. 13, the housing main body 31 is formed with a partition wall 311 separating two rows of the terminal storage rooms R from each other, aligned in a length-wise direction of the housing main body 31. A pair of lances 311*a* extends from opposite surfaces of the partition wall 311. Each of the lances 311*a* acts as a projection with which the projection 212*a* of the spring support portion 212 makes engagement.

The housing main body 31 is formed with pedestals 312*a* extending from inner walls 312 facing the partition wall 311. Each of the pedestals 312*a* acts as a projection with which the projection 22*c* of the support portion 22 makes engagement. Furthermore, the housing main body 31 is formed with engagement projections 313 and engagement projections 314, both of which engaging a housing of the male electric connector 100, when the housing main body 31 and the housing of the male electric connector 100 are fit to each other.

Each of the flanges 31 is formed with a through-hole 32*a* through which the printed circuit board P1 is fixed by means of a fixing unit.

The male electric connector 100 mounted on the printed circuit board P2 is explained hereinbelow with reference to the drawings.

Figure 9:
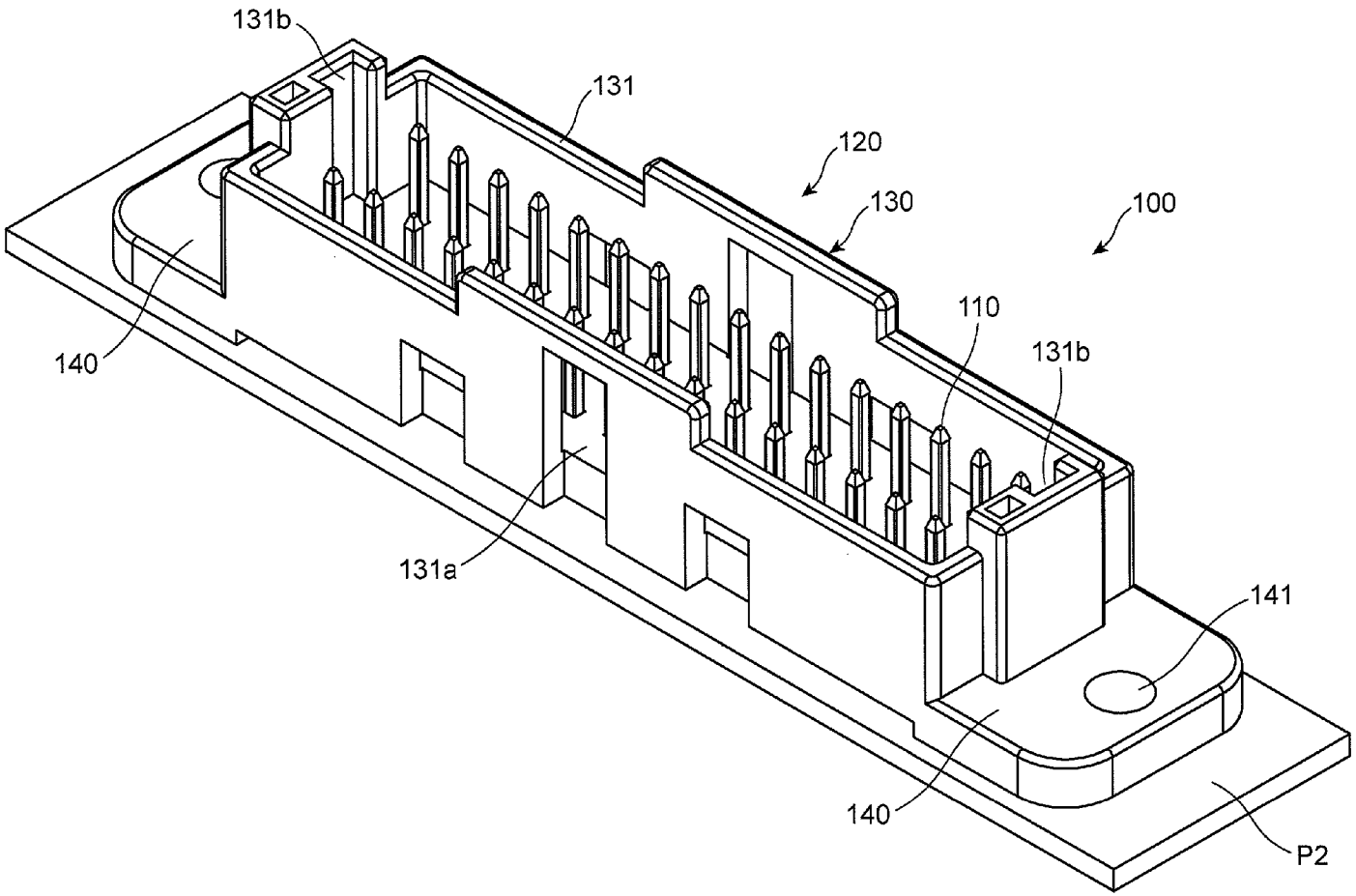
FIG. 9 is a perspective view of a male electric connector into which the electric connector illustrated in FIG. 1 is inserted, mounted on a printed circuit board.
Figure 10:
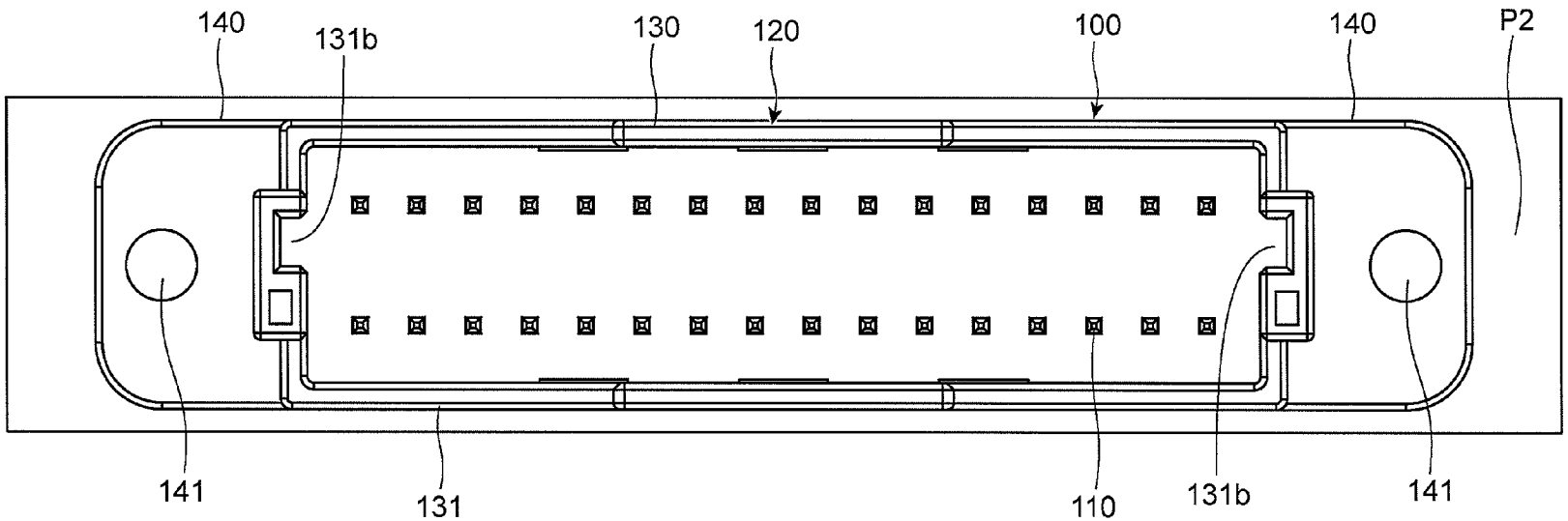
FIG. 10 is a plan view of the electric connector illustrated in FIG. 9.
Figure 11:
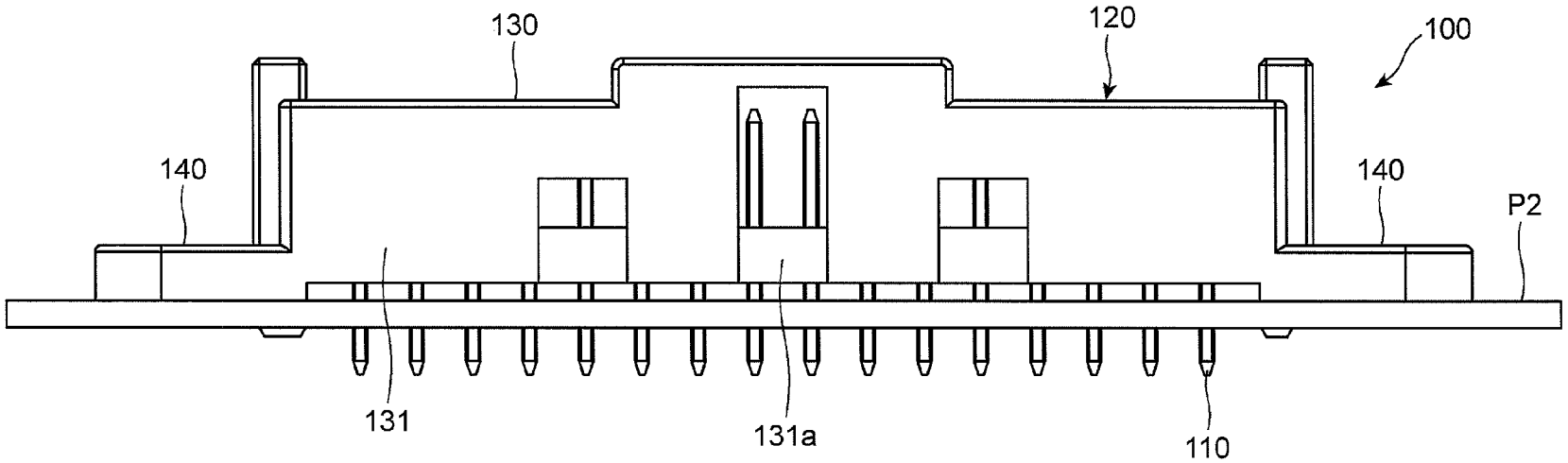
FIG. 11 is a front view of the electric connector illustrated in FIG. 9.
Figure 12:
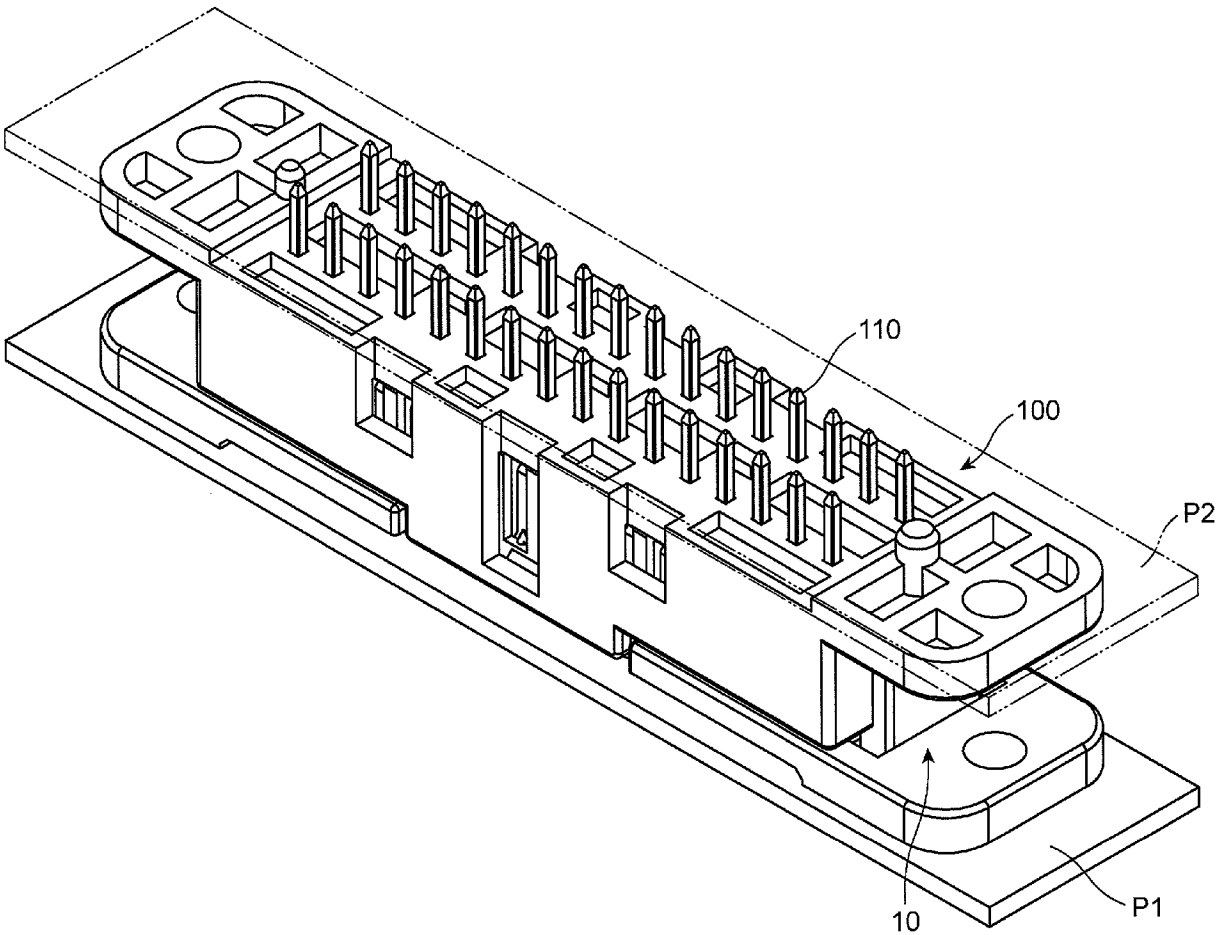
FIG. 12 is a perspective view of the male electric connector illustrated in FIG. 9, inserted into the female electric connector illustrated in FIG. 1.

As illustrated in FIGS. 9 to 11, the electric connector 100 includes a plurality of needle-shaped male connector terminals 110 having one end to be inserted into the printed circuit board P2 and the other end to be inserted into the connector terminal 20 (see FIG. 1) of the electric connector 10, and a housing 120 into which the housing 30 of the electric connector 10 is inserted and fit.

The housing 120 includes a housing main body 130 in the form of a box, which has a bottom and is open for fitting with the housing 30 of the electric connector 10, and, in which the male connector terminals 110 are fixed in a matrix. Flanges 140 extend from opposite ends of the housing main body 130 in a length-wise direction of the housing main body 130.

The housing main body 130 is formed at a peripheral wall 131 thereof with engagement openings 131*a* and 131*b* into which the engagement projections 313 and 314 of the housing 30 of the male electric connector 10 are fit, respectively. Since the engagement between the engagement projections 313 and the engagement openings 131*a* and between the engagement projections 314 and the engagement openings 131*b* is designed to be a fitting with play (so-called free fit), the electric connectors 10 and 100 are able to slightly move relative to each other. Each of the flanges 140 is formed with a through-hole 141 in which the printed circuit board P2 is fixed by means of a fixing unit.

The electric connector 10 in accordance with the first embodiment of the present invention, having the above-mentioned structure, is used as follows.

The female electric connector 100 mounted on the printed circuit board P2 is coupled to the male electric connector 10 mounted on the printed circuit board P1. Each of the male connector terminals 110 arranged in the housing 120 of the electric connector 100 is inserted into the insertion space S of the connector terminal 20.

Being inserted into the connector terminal 20, the male connector terminal 110 makes contact at one side thereof with the contact portion 211 and at the other side thereof with the spring portion 213. The male connector terminal 110 deeply enters the connector terminal 20, making sliding contact with the connector terminal 20.

As the male connector terminal 110 deeply enters the connector terminal 20, the spring portion 213 makes contact with the male connector terminal 110 with a high compression force derived from an elastic reaction force of the spring portion 213.

Herein, it is supposed that the male connector terminal 110 is inserted into the connector terminal 20 with a positional relation between the printed circuit boards P1 and P2 being deflected, or that after the male connector terminal 110 has been inserted into the connector terminal 20, a positional relation between the printed circuit boards P1 and P2 is deflected due to oscillation, and hence, the male connector terminal 110 now being inserted into the connector terminal 20 oscillates.

Figure 14:
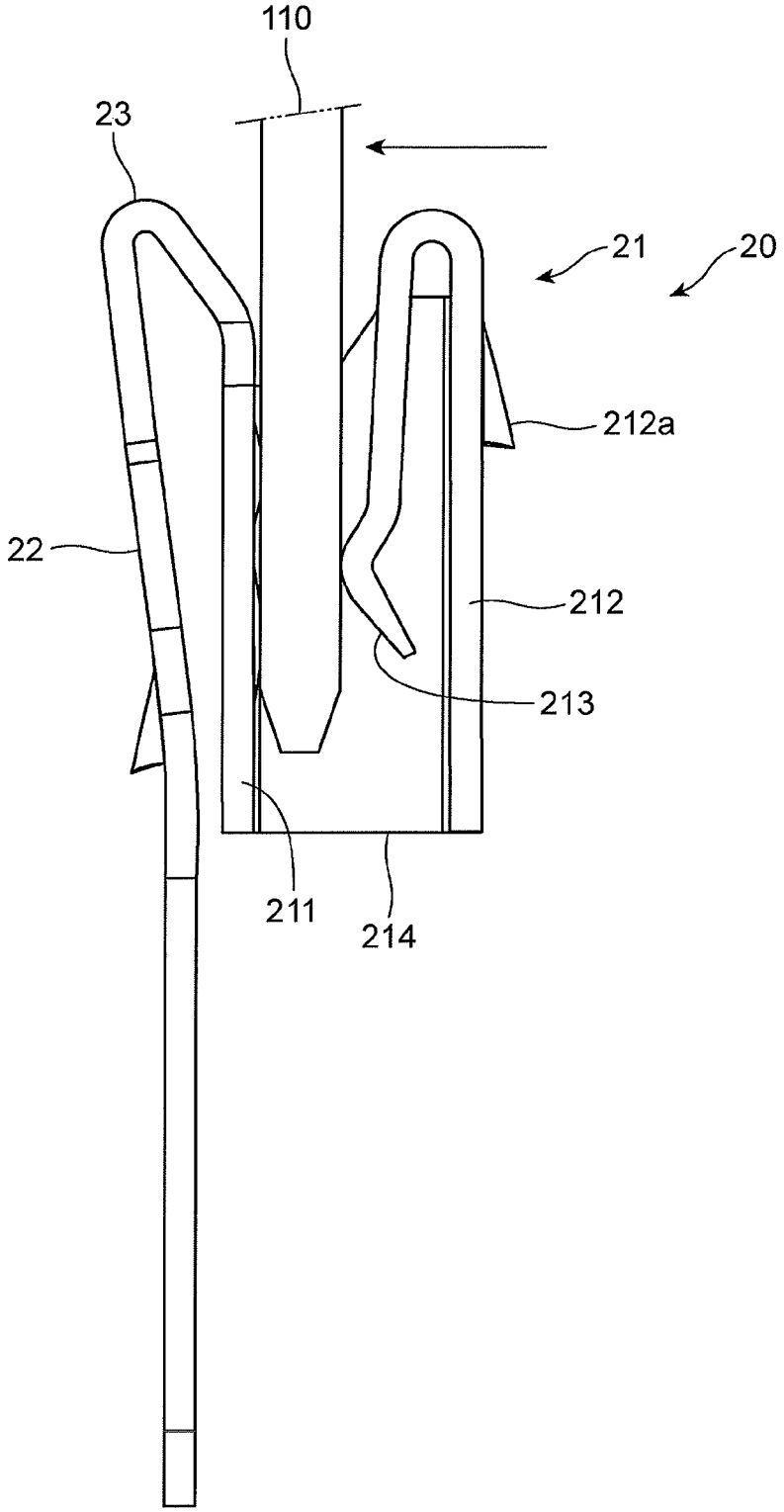
FIG. 14 is a front view of the male connector inserted into the electric connector illustrated in FIG. 8, moving horizontally towards the contact portion.

For instance, if the male connector terminal 110 deflects towards the contact portion 211, as illustrated in FIG. 14, the contact portion 211 is compressed due to the deflection of the male connector terminal 110. Thus, a space between the contact portion 211 and the spring portion 213 is caused to expand. However, since the contact portion 211 and the spring support portion 212 are connected to each other through the joint portion (space limiter) 214, the spring portion 213 is drawn towards the contact portion 211 by the joint portion 214.

Consequently, it is possible to move the main body 21 to a position to which the male connector terminal 110 has moved, since the resilient portion 23 supported by the support leg 22 is resiliently closed together with a distal end of the support leg 22, maintaining a contact between the main body 21 and the male connector terminal 110. Thus, since a space between the contact portion 211 and the spring support portion 212 is kept constant, it is possible to maintain a contact pressure which the spring portion 213 exerts on the male connector terminal 110 by virtue of a resilient reaction force thereof.

Figure 15:
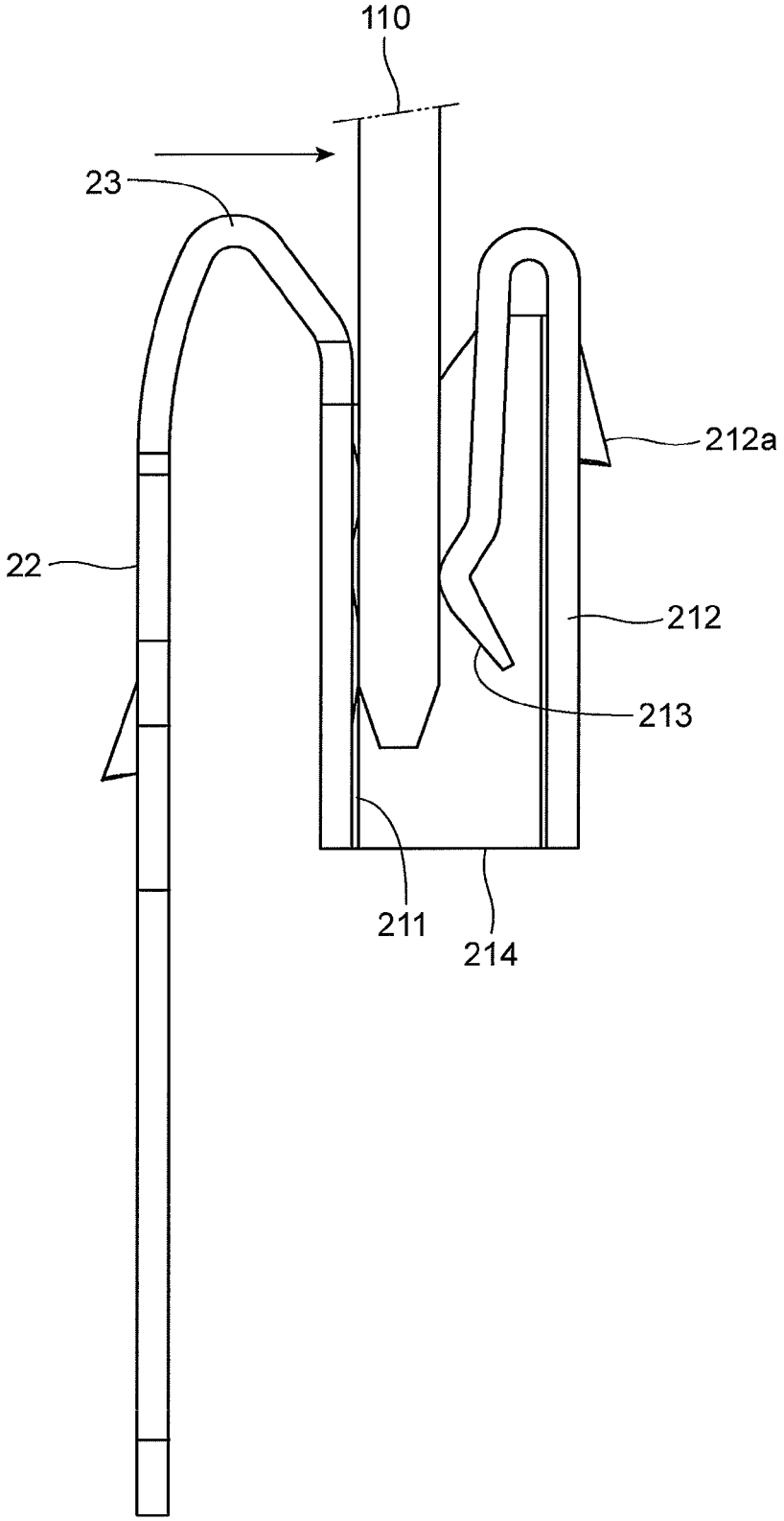
FIG. 15 is a front view of the male connector inserted into the electric connector illustrated in FIG. 8, moving horizontally towards the support portion.
Figure 16:
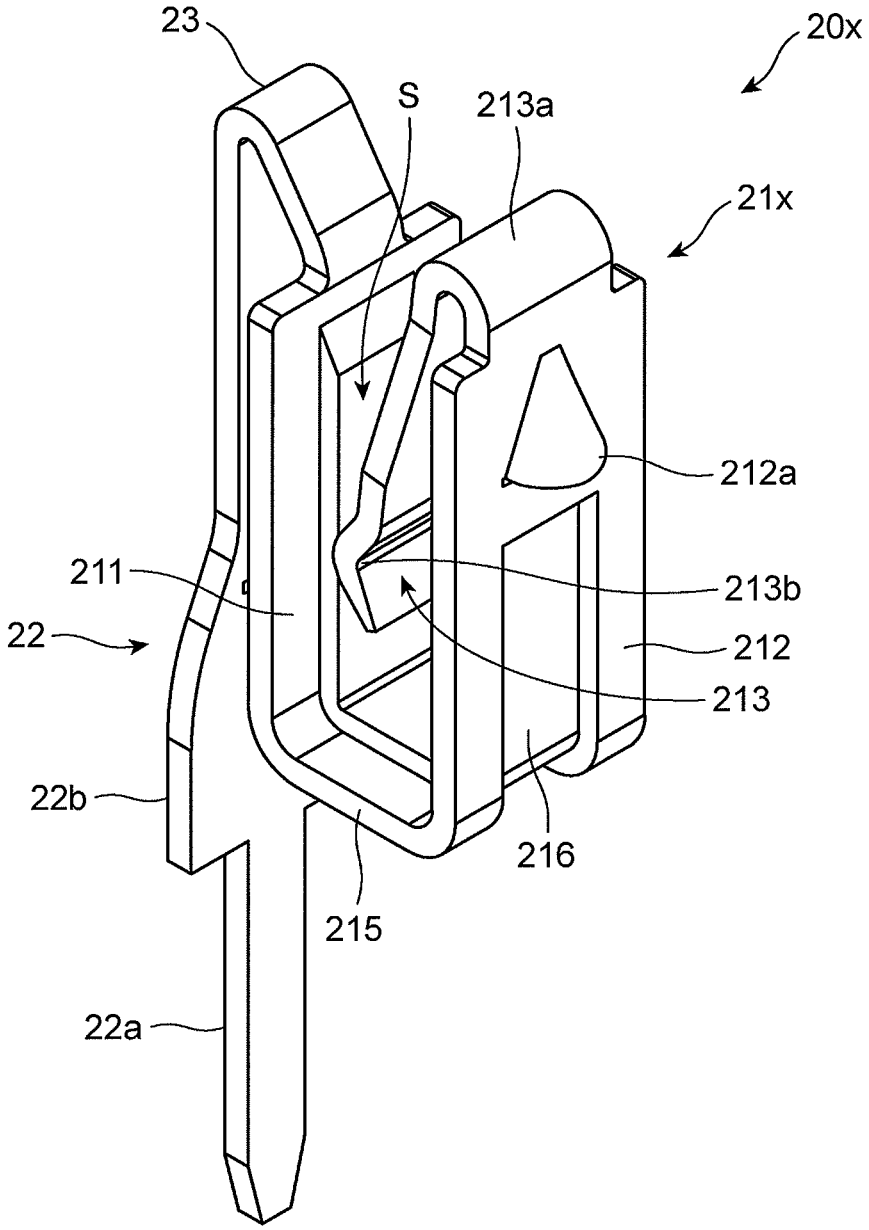
FIG. 16 is a perspective view of the connector terminal in accordance with the second embodiment of the present invention, viewed in a direction of the support portion.
Figure 17:
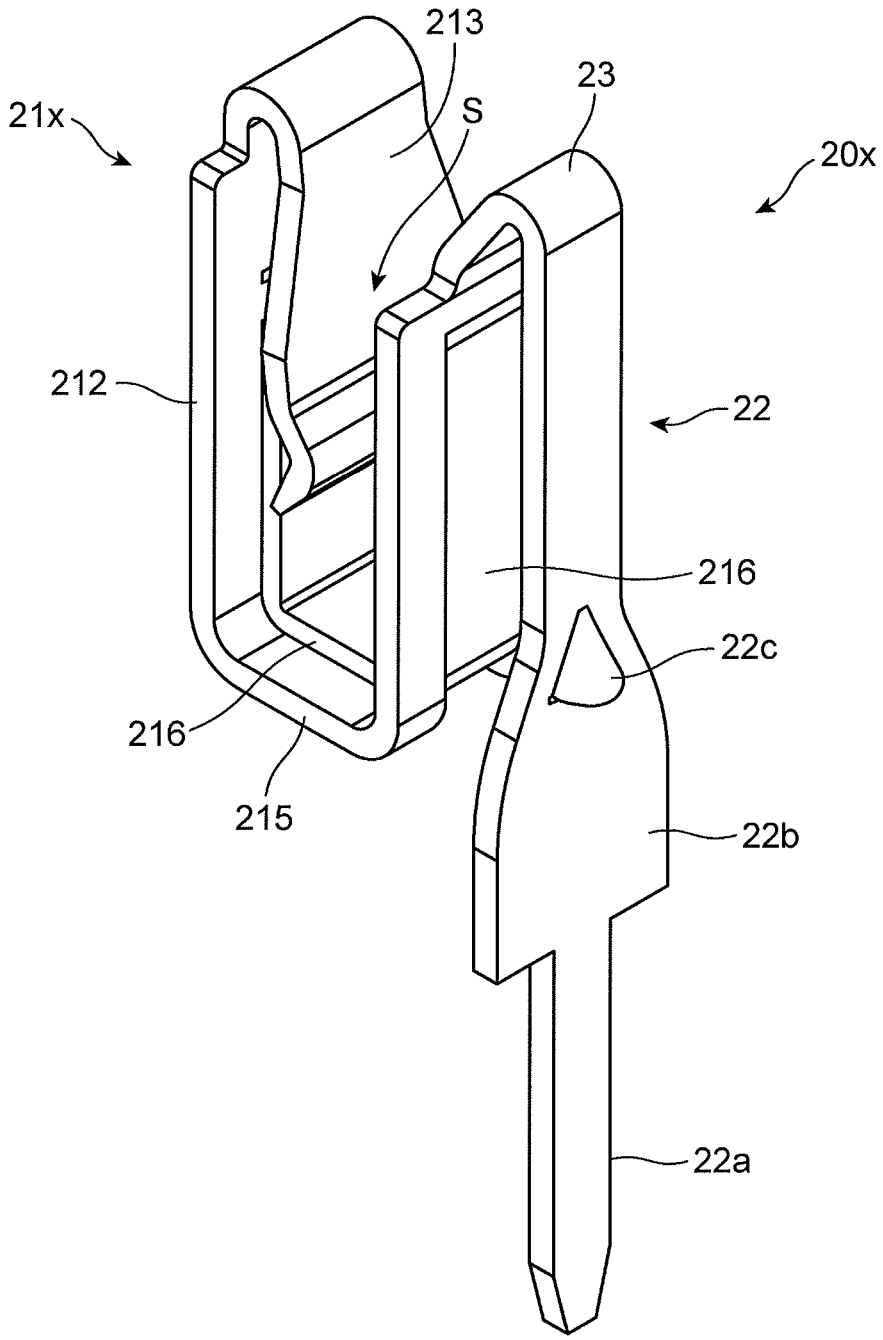
FIG. 17 is a perspective view of the connector terminal illustrated in FIG. 16, viewed in a direction of the support leg.
Figure 18:
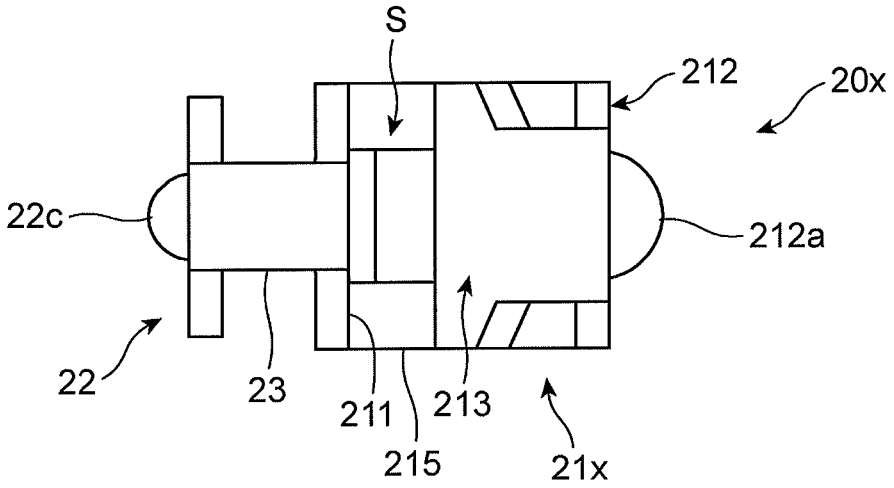
FIG. 18 is a plan view of the electric connector illustrated in FIG. 16.
Figure 19:
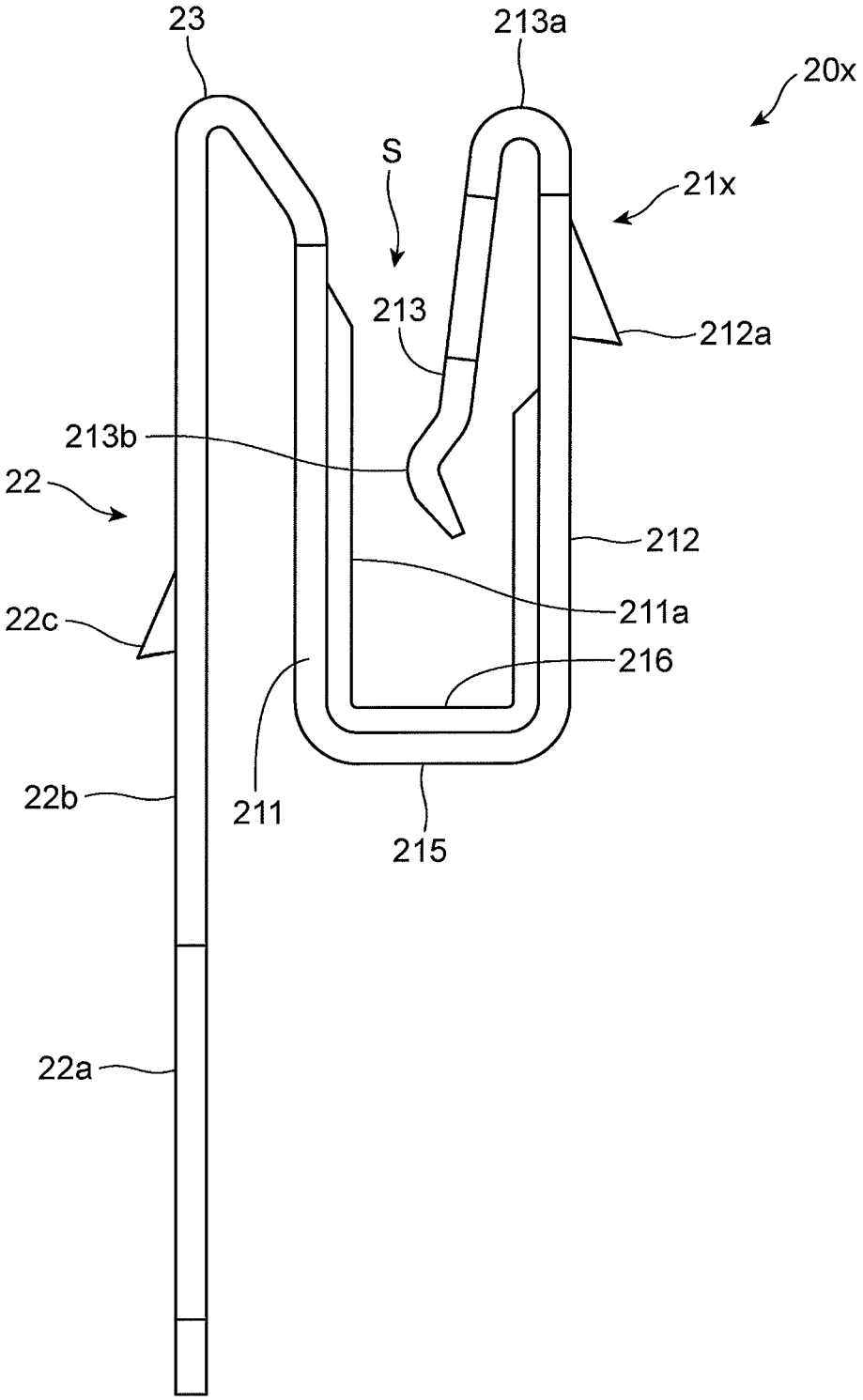
FIG. 19 is a front view of the electric connector illustrated in FIG. 16.
Figure 20:
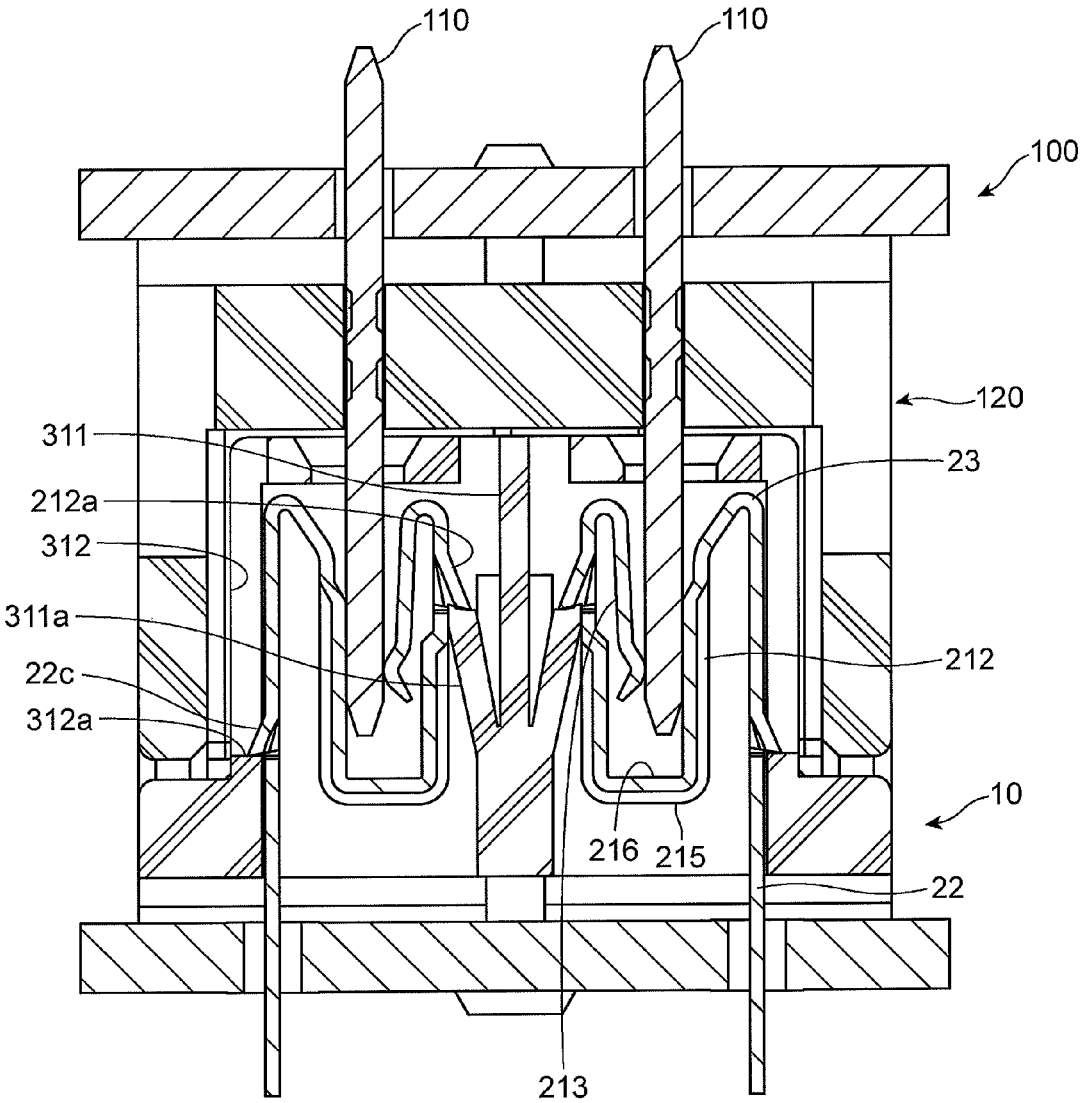
FIG. 20 is a cross-sectional view of a female electric connector inserting the connector terminals illustrated in FIG. 16, being inserted into the male connector.
Figure 21:
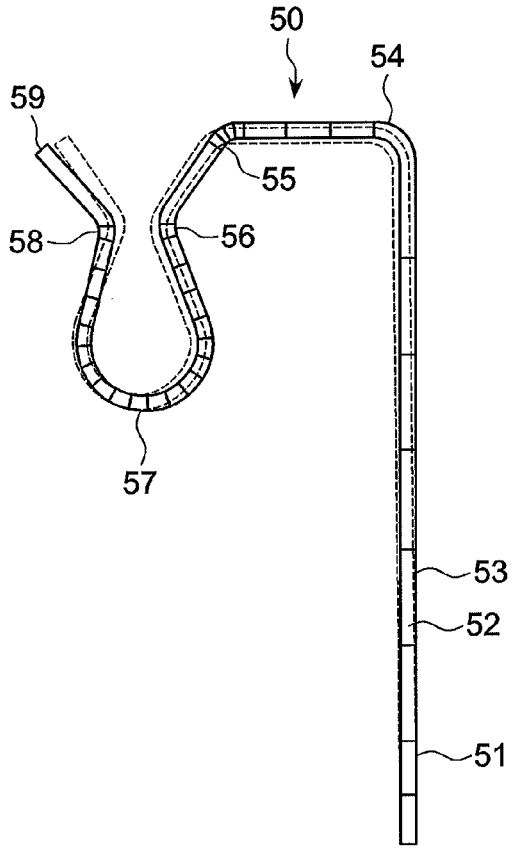
FIG. 21 PRIOR ART
FIG. 21 is a plan view of the conventional spring terminal.
Figure 22:
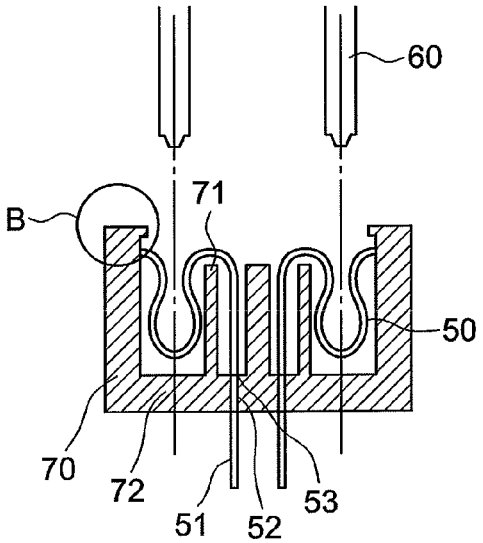
FIG. 22 PRIOR ART
FIG. 22 is a cross-sectional view of a housing into which the spring terminal illustrated in FIG. 21 is inserted.

As illustrated in FIG. 15, if the male connector terminal 110 deflects towards the spring portion 213, the spring portion 213 is compressed due to the deflection of the male connector terminal 110 so that a space between the spring portion 213 and the contact portion 211 is caused to expand. However, since the contact portion 211 and the spring support portion 212 are connected at sides thereof to each other through the joint portion 214, the joint portion 214 acts as a space limiter for preventing a space between the contact portion 211 and the spring support portion 212 from expanding. Thus, a proximal end of the spring portion 213 through which the spring portion 213 and the spring support portion 212 are connected to each other is kept unmoved.

Consequently, it is possible to move the main body 21 to a position to which the male connector terminal 110 has moved, since the resilient portion 23 is resiliently open, maintaining a contact between the main body 21 and the male connector terminal 110. Thus, since a space between the contact portion 211 and the spring support portion 212 is kept constant, it is possible to maintain a contact pressure which the spring portion 213 exerts on the male connector terminal 110 by virtue of a resilient reaction force thereof.

As mentioned above, even if a positional relation between the printed circuit boards P1 and P2 were deflected due to oscillation so that the male connector terminal 110 were deflected, the main body 21 could swing and follow the deflection at its entirety, maintaining a contact pressure which the contact portion 211 and the spring portion 213 exert on the male connector terminal 110. Thus, it is possible to avoid reduction in reliability to electrical connection between the male connector terminal 110 and the connector terminal 20.

Furthermore, even if the male connector terminals 110 were deflected such that the spring support portion 212 is caused to outwardly deflect, since the projection 212*a* of the spring support portion 212 makes engagement with the lance 311*a* of the housing main body 31 (see FIG. 13), a space between the spring support portion 212 and the support leg 22 is avoided from expanding, ensuring reduction in reliability to electrical connection between the male connector terminal 110 and the connector terminal 20.

Since the contact portion 211 is formed with at least one projection 211*a* making contact with one side of the male connector terminal 110, and the spring portion 213 includes the contact 213*b* bent substantially V-shaped, at a distal end thereof, a contact pressure can be focused on both the projection 211*a* and the contact 213*b*, ensuring that the male connector terminal 110 can be surely sandwiched between the contact portion 211 and the spring portion 213.

Though the resilient portion 23 formed at a distal end of the support leg 22 is connected to a distal end or a top end of the contact portion 211 in the first embodiment, the resilient portion 23 may be connected to a distal end or a lower end of the contact portion 211, for instance. However, if the resilient portion 23 is connected to a distal end or a lower end of the contact portion 211, the main body 21 is located higher by a height of the resilient portion 23. Thus, it is possible to prevent the connector terminal from having an increased height by connecting the resilient portion 23 to a top end of the contact portion 211 as explained in the first embodiment, and the electric connector 10 can be designed low in height.

Figure 23:
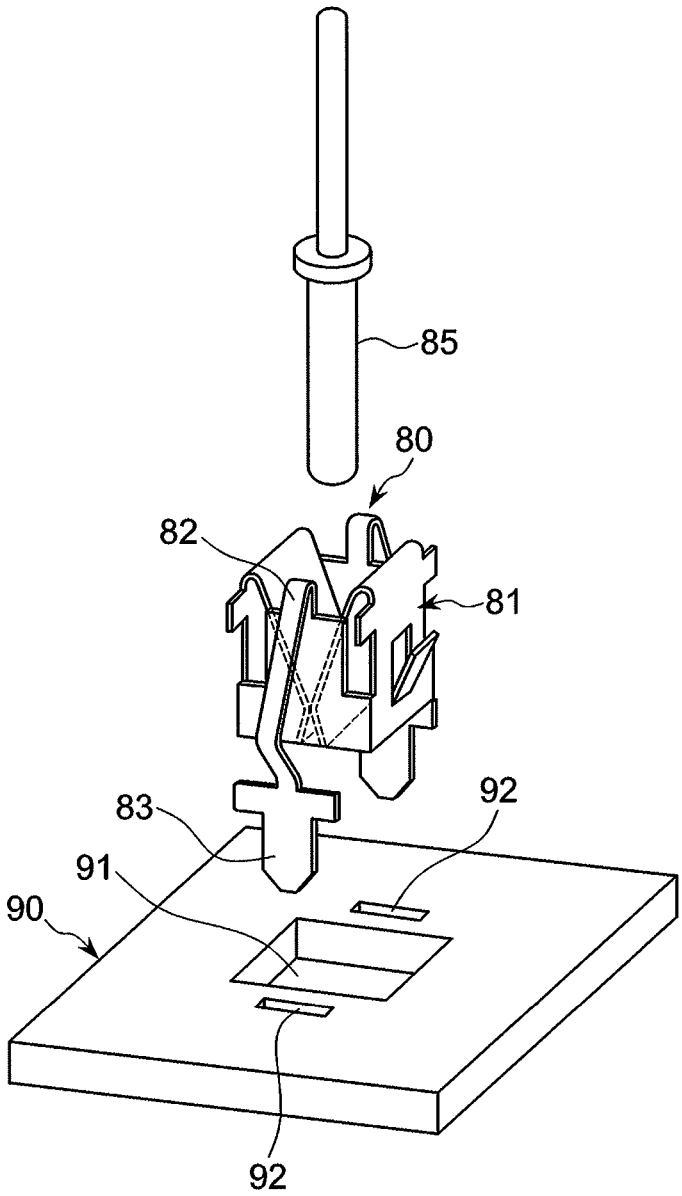
FIG. 23 PRIOR ART
FIG. 23 is a perspective view of the conventional connector.

In the connector 20 illustrated in FIG. 23, the connector 20 in the form of a box is inserted into the through-holes 32 of and fixed on the printed circuit board 30. Thus, even if the terminal pin 11 having been inserted into the connector 20 were deflected, it would not be possible to cause deflection to the connector 20. Accordingly, a plate spring of the connector 20 towards which the terminal pin 11 was deflected exerts a high contact pressure on the terminal pin 11, but the other plate spring is located away from the terminal pin 11 and thus exerts a low contact pressure on the terminal pin 11.

Since the connector terminal 20 in the first embodiment is designed to include the main body 21 connected to the support leg 22 through the resilient portion 23, the main body 21 suspends from the resilient portion 23 and thus is free relative to the support leg 22, it is possible to follow the main body 21 to the deflection of the male connector terminal 110.

Second Embodiment

A connector terminal 20X to be employed in the male electric connector in accordance with the second embodiment of the present invention is explained hereinbelow with the drawings. Parts or elements illustrated in FIGS. 16 to 20 that correspond to those illustrated in FIGS. 4 to 8 and 13 have been provided with the same reference numerals, and will not be explained.

As illustrated in FIGS. 16 to 20, the connector terminal 20X includes a main body 21X including a connector 215 connecting a bottom (a lower end) of the contact portion 211 and a bottom (a lower end) of the spring support portion 212 to each other, and a stepped portion 216 formed over the contact portion 211, the joint portion 215 and the spring support portion 212 for the purpose of preventing the contact portion 211, the joint portion 215 and the spring support portion 212 from being deformed. The joint portion 215 acts as a space-limiter for limiting a space between the contact portion 211 and the spring support portion 212.

The stepped portion 216 is formed by beading so as to have a recessed surface at one side and a raised surface at the other side. Thus, in the fabrication of the connector terminal 20X, the stepped portion 216 can be formed together with the projection 212*a* of the spring support portion 212 and the projection 22*c* of the support leg 22 without carrying out any additional steps, when the projection 212*a* and the projection 22*c* are formed by beading in a step to be carried out prior to bending a metal plate. Furthermore, by forming the stepped portion 216 by beading, two stepped portions each including a raised surface and a recessed surface can be formed in a single step over the contact portion 211, the joint portion 215, and the spring support portion 212. Though the stepped portion 216 illustrated in FIGS. 16 and 17 has a trapezoidal cross-section, the stepped portion 216 may be designed to have a semi-circular cross-section.

Since the stepped portion 216 enhances the rigidity of the contact portion, the joint portion 215 and the spring support portion, which are substantially U-shaped, the contact portion 211 and the spring support portion 212 are not prone to be open in a direction away from each other. Thus, since a contact pressure which the spring portion 213 exerts on the male connector terminal 110 by virtue of a resilient reaction force thereof can be maintained, deterioration in reliability to the electrical contact between the connector terminal 20X and the male connector terminal 110 can be avoided.

Furthermore, since the main body 21X and the support leg 22 are connected to each other through the resilient portion 23, similarly to the connector terminal 20 in accordance with the first embodiment, the resilient portion 23 elastically deforms to be closed or open depending on the deflection of the swinging main body 21 to thereby be able to cause the main body 21 to follow the deflection of the male connector terminal 110, maintaining a contact pressure which the spring portion 213 exerts on the male connector terminal 110.

As mentioned above, even if a positional relation between the printed circuit boards P1 and P2 were deflected due to oscillation, the main body 21X could swing and follow the deflection at its entirety, maintaining a contact pressure which the contact portion 211 and the spring portion 213 exert on the male connector terminal 110. Thus, it is possible to avoid deterioration in reliability of electrical connection between the male connector terminal 110 and the connector terminal 20X.

Since a portion of the stepped portion 216 formed in the contact portion 211 has the same function as that of the projection 211*a* (see FIG. 4) of the contact portion 211, it is possible to omit the formation of the projection 211*a* making contact with the male connector terminal 110, by forming the stepped portion 216 in the contact portion 211.

Though the stepped portion 216 in the second embodiment is formed by beading in the insertion space S into which the male connector terminal 110 is inserted, there may be formed a rib over the contact portion 211, the connector 215 and the spring support portion 212 in place of the stepped portion 216.

The electric connectors 10 in accordance with the first and second embodiments have been explained above. The male and female electric connectors in the first and second embodiments are designed to electrically connect two printed circuit boards to each other, but it should be noted that the male and female electric connectors may be connected to cables or anything else.

INDUSTRIAL APPLICABILITY

The electric connector in accordance with the present invention can be broadly employed in fields such as electric, electronic and automobile industries, as a connector to be used for electric and electronic parts and to be fit into a printed circuit board, or a connector to be mounted in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-167007 filed on Jul. 27, 2012 including specification, claims, drawings and summary is incorporated herein by reference in its entirety.

What is claimed is:

1. A connector terminal comprising:

a main body;

a support leg; and a resilient portion;

wherein said main body includes:

a contact portion configured to contact a first side of a male connector terminal of a male electric connector;

a spring portion facing said contact portion and configured to contact a second side of the male connector terminal;

a support portion connected to said spring portion to support said spring portion; and a space-limiter connected at a first side thereof to said contact portion and connected at a second side thereof to said support portion so as to prevent a space between said contact portion and said support portion from enlarging, wherein said support leg is adapted to be fixed at a first end thereof, wherein said resilient portion connects a second end of said support leg and said contact portion to each other such that a gap is formed between said support leg and said contact portion to allow said contact portion to move toward said support leg, and said resilient portion being resiliently deformable based on a deflection of said main body.

2. The connector terminal as set forth in claim 1, wherein said resilient portion connects a top end of said contact portion and said support leg to each other.

3. The connector terminal as set forth in claim 1, wherein said resilient portion connects said support leg and a bottom end of said contact portion to each other.

4. The connector terminal as set forth in claim 1, wherein said space-limiter comprises a joint portion connecting a side of said contact portion and a side of said support portion to each other.

5. The connector terminal as set forth in claim 1, wherein said space-limiter comprises a joint portion connecting a lower end of said contact portion and a lower end of said support portion to each other.

6. The connector terminal as set forth in claim 5, further comprising a stepped portion over said contact portion, said joint portion and said support portion.

7. The connector terminal as set forth in claim 6, wherein said stepped portion is formed of a bead recessed at a first side and raised at a second side.

8. The connector terminal as set forth in claim 1, wherein said contact portion has at least one projection for engaging the first side of the male connector terminal.

* * * * *